US006645129B2

(12) United States Patent
Eschenbach

(10) Patent No.: US 6,645,129 B2
(45) **Date of Patent: *Nov. 11, 2003**

(54) RECUMBENT EXERCISE APPARATUS WITH LEG CURL

(76) Inventor: Paul William Eschenbach, 143 Lakeland Ave., Moore, SC (US) 29369

( * ) Notice: Subject to any disclaimer, the term of this patent is extended or adjusted under 35 U.S.C. 154(b) by 260 days.

This patent is subject to a terminal disclaimer.

(21) Appl. No.: 09/811,742

(22) Filed: Mar. 20, 2001

(65) Prior Publication Data

US 2002/0037793 A1 Mar. 28, 2002

Related U.S. Application Data

(63) Continuation-in-part of application No. 09/625,212, filed on Jul. 24, 2000, now Pat. No. 6,500,099.

(51) Int. Cl.[7] ..... A63B 26/00

(52) U.S. Cl. ..... 482/140; 482/51; 482/57; 482/121

(58) Field of Search ..... 482/51, 57, 58, 482/59, 60, 63, 64, 121, 122, 126, 124, 140, 53, 100, 135

(56) References Cited

U.S. PATENT DOCUMENTS

| | | | | |
|---|---|---|---|---|
| 2,924,214 A | | 2/1960 | Zak | |
| 4,240,627 A | | 12/1980 | Brentham | |
| 4,465,274 A | | 8/1984 | Davenport | |
| 4,519,604 A | | 5/1985 | Arzounian | |
| 4,538,804 A | | 9/1985 | Zibell | |
| 4,550,908 A | | 11/1985 | Dixon | |
| 4,627,614 A | * | 12/1986 | de Angeli | 482/97 |
| 4,684,126 A | * | 8/1987 | Dalebout et al. | 482/138 |
| 4,717,146 A | * | 1/1988 | Nohara | 482/62 |
| 4,809,976 A | | 3/1989 | Berger | |
| 4,974,840 A | | 12/1990 | Welch | |
| 5,039,088 A | | 8/1991 | Shifferaw | |
| 5,279,530 A | | 1/1994 | Hess | |
| 5,505,679 A | | 4/1996 | McBride | |
| 5,665,041 A | * | 9/1997 | Hsieh | 482/140 |

FOREIGN PATENT DOCUMENTS

| | | |
|---|---|---|
| CH | 442103 | 1/1968 |
| GB | 403165 | 12/1933 |

OTHER PUBLICATIONS

Top 10 Abdominal Exercises, Club Industry Magazine, May, 2000, p. 69.

* cited by examiner

*Primary Examiner*—Nicholas D. Lucchesi
*Assistant Examiner*—Tam Nguyen

(57) ABSTRACT

The present invention relates to the field of pull/push exercise with an exercise machine that exercises the abdominal, back and leg muscles with the operator recumbent in the face upwards position. Foot contacts follow an arcuate curve path positioned above the recumbent operator. Resistance is provided for each foot contact where the abdominal muscles of the operator pull the lower leg contact towards the operator. Handles are provided to support the arms of the operator. A situp assist device can be used in conjunction with leg pull to exercise the upper abdominals. A leg curl feature is added to the apparatus to allow leg curls. Weight stack resistance is also available.

27 Claims, 3 Drawing Sheets

RECUMBENT EXERCISE APPARATUS WITH LEG CURL

This application is a Continuation-in-Part of U.S. patent application Ser. No. 09/625,212 filed Jul. 24, 2000 now U.S. Pat. No. 6,500,099.

BACKGROUND OF THE INVENTION

1. Field

The present invention relates to the field of recumbent leg pull exercise apparatus. More particularly, the present invention relates to an exercise apparatus that exercises the abdominal, back and leg muscles with the operator prone on his back whereby the feet follow an arcuate curve with pull/push movement. Leg curls are performed with the operator face down using a leg curl extension.

2. State of the Art

The benefits of regular exercise to improve overall health, appearance and longevity are well documented in the literature. One of the most difficult muscle groups to exercise is the abdominals. For exercise enthusiasts the search continues for safe apparatus that provides exercise to tone the abdominals without back strain.

Many devices have appeared recently to aid the user in the performance of situps from a prone face-up position with the intent of easing back strain. Various situp assist devices have appeared recently on the market for the upper abdominals.

Devices to aid the sit-up movement such as Evans in U.S. Pat. No. 5,120,052, Steinmetz in U.S. Pat. No. 5,419,750 and Brown in U.S. Pat. No. 5,577,987, as just a few, that provide for a recumbent operator to contract the upper abdominals while raising the upper body with the aid of such device. Another group of abdominal exercise aids such as Boland in U.S. Pat. No. 5,759,138, Conner in U.S. Pat. No. 5,766,118 and Hern in U.S. Pat. No. 6,013,014 start in a seated posture and lean forward against the resistance of an apparatus. Oeglaend in German Pat. No. 3631622 shows an adjustable bench with cable for exercise.

The simplest kneel-prone-kneel device is the classic exercise wheel. Shiek et al. in U.S. Pat. No. D306,886 shows a pair of wheels rollably attached to a straight rod used for hand grip. Mattox in U.S. Pat. No. 5,261,866 adds elastic tubing to the handles where the knees hold the tubing while the operator is in the push mode to assist in the return mode. A spiral spring is added to the exercise wheel in R.O.C. Pat. 276503 and to a pair of wheels by Barbeau in U. S. Pat. No. 2,821,394.

Semi-recumbent cycles such as Chang in U.S. Pat. No. 6,001,046, Praprotnik in U.S. Pat. No. 4,222,376, Bostic et al. in U.S. Pat. No. D353,422, Dranselka in U.S. Pat. No. 4,262,902 and Jennings in U.S. Pat. No. 4,776,583 show simple bicycle cranks to be operated from a seated position with the hip above or about the same level as the crank.

Another group of cycles intended to be ridden from the recumbent position such as Mousel in U.S. Pat. No. 4,601,464, Dranselka in U. S. Pat. No. 4,739,984, McJunkin, Jr. et al. in U.S. Pat. No. 4,925,184, Shibata in U.S. Pat. No. 5,743,050, Kock in U.S. Pat. No. 4,979,737 and Douglas in U.S. Pat. No. 4,169,591 are simple bicycle cranks attached to a bed by different means.

Recently several semi-recumbent cycles such as Stearns et al. in U.S. Pat. No. 6,077,197, Maresh in U.S. Pat. Nos. 5,707,321 and 5,938,570, Eschenbach in U.S. Pat. No. 5,836,855 and Rodgers, Jr. in U.S. Pat. No. 5,611,758 have added elliptical foot movement to a seated semi-recumbent operator.

Noharan in U.S. Pat. No. 4,717,146, Zibell in U.S. Pat. No. 4,538,804 and Welch in U.S. Pat. No. 4,974,840 show rotary cranks above the operator from adjustable bench positions. Arzonnian in U.S. Pat. No. 4,519,604 shows a rotary crank above a recumbent operator where the crank axis and bench oscillate.

Hess in U.S. Pat. No. 5,279,530, Dixon in U.S. Pat. No. 4,550,908, Zak in U.S. Pat. No. 2,924,214 and McKenzie in UK Pat. No. 403165 show foot contacts that slide away from an operator prone or seated against resistance.

Brentham in U.S. Pat. No. 4,240,627, Davenport in U.S. Pat. No. 4,465,274, Dalebout et al. in U.S. Pat. No. 4,684,126, Berger in U.S. Pat. No. 4,809,976, McBride et al. in U.S. Pat. No. 5,505,679, Shifferaw in U.S. Pat. No. 5,039,088 and Moreillon in Swiss Pat. No. 442103 show swing arms for the feet to operate in a seated position.

One of the top 10 abdominal exercises listed by Club Industry Magazine, May, 2000, page 69, lists number 7 as the "Bicycle". The article gives the following directions: "lie on back and lift knees to a 90 degree angle from the floor; Bring the right knee in to the left elbow as the left leg extends; Repeat on the other side; Continue to alternate while keeping abdominals contracted". Observation of this exercise shows that the feet can follow an arcuate path instead of a circular bicycle path. The abdominals are exercised because the feet are moved towards the exerciser.

None of the prior art reviewed including samples above address the number 7 exercise with the feet moving along an arcuate curve path while recumbent with knees bent above the upper body operating with resistance. One of the objectives of the present invention is to provide a back and forth movement for the feet where one foot pulls toward the operator against resistance along an arcuate curve path while the other foot pushes away from the upper body along the arcuate path as the leg extends. Alternately, both feet pull together.

Another objective of this invention is to provide pull/push apparatus motion which exercises the abdominals, back and leg muscles in a novel manner without back strain. Another objective of this invention is to combine the benefits of a situp assist device with the leg pull apparatus for a more complete workout of the abdominals. Another objective of the present invention is a leg curl extension as an alternate exercise. Another object of this invention is the use of stack weights as the resistance.

SUMMARY OF THE INVENTION

The present invention provides a pair of lower leg contacts in the form of rollers that can be pulled by the abdominal and leg muscles towards the recumbent operator. Rollers are generally composed of foam material and can rotate or be stationary. One roller contacts the instep of the foot while the other roller supports the heel of the foot for back and forth movement. Handles are provided for the hands during operation of the exercise apparatus. A situp assist can be used with the leg pull apparatus and a leg curl option is available.

The present invention is intended for a recumbent operator having back downward with knees bent where the feet move along an arcuate curve path located above the torso of the operator. An adjustable bench is provided to support the back. A framework supports the seat, bench and a pair of guide links. The feet are positioned in a pair of foot contacts guided by each guide link to follow an arcuate curve path. An adjustable resistance is imposed upon the guide links.

The lower leg contacts are configured to allow the abdominal muscles to pull one foot towards a recumbent operator against the resistance as the knee bends while the other foot pushes away from the operator as the leg extends. The feet alternately pull and push the lower leg contacts to exercise the leg muscles as well as the abdominals. Alternately, both feet pull together.

In the preferred embodiment, the operator is prone on the floor or other supporting surface face up. The lower leg contacts are rollers attached to a guide link for each foot that follows an arcuate path. One roller is in contact with the instep of the foot while the other is in contact with the heel of the foot. As the lower leg is pulled toward the body, the foot is trapped between the roller pair allowing force to be transferred from the guide link to the lower leg. Each guide link is connected to a pair of support links that are pivoted to the framework. The general length of the support links is similar to the length of the upper leg between the hip and knee joints of the operator. However, other support link lengths can also be used and be within the scope of this invention.

A guide link extension is quickly attachable to the guide link for each foot to allow leg curls. A third roller is added to the guide link extension that provides heel contact for an operator prone in the face down position. It is understood that one of the roller pairs could alternately be repositioned for leg curls.

Resistance is provided by elastic bands that attach to the guide links, wrap around guide rollers and attach to the framework at different locations for variable intensity resistance. Alternately, adjustable damping or other means of resistance can be used.

In an alternate embodiment, the operator is supported by an adjustable bench where the height and angle may be varied. A situp assist device is supported by the bench for exercise of the upper abdominals. A weight stack engages the guide link through a cable system to provide variable gravity resistance. The rollers, guide links and support links are similar to the preferred embodiment.

Both the preferred and alternate embodiment are shown with independent guide links whereby the feet can operate opposed or in unison. Each embodiment includes lower leg contacts that move along arcuate curves above the recumbent operator. The length of the curve is determined by the operator. The feet move with a pull/push motion against adjustable resistance. Handles are provided in each embodiment to accommodate the hands of the operator.

Each of the embodiments shown contains a minimum number of elements that comprise the linkage to guide the foot contacts along an arcuate curve path. It should be obvious that linkage systems having additional elements can also be used to guide the feet along an arcuate path and are considered within the scope of the present invention.

Each of the embodiments provide pull/push apparatus motion which exercises the abdominals, back and leg muscles in a novel manner without back strain.

BRIEF DESCRIPTION OF THE DRAWINGS

The foregoing and other objects and features of the present invention will become more fully apparent from the following description and claims, taken in conjunction with the drawings. Understanding that these drawings depict only typical embodiments of the invention and are, therefore, not to be considered limiting of its scope or combinations, the invention will be described with addition specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 3, is not intended to limit the scope of the invention, as claimed, but is merely representative of the presently preferred embodiments of the invention.

Figure 1:
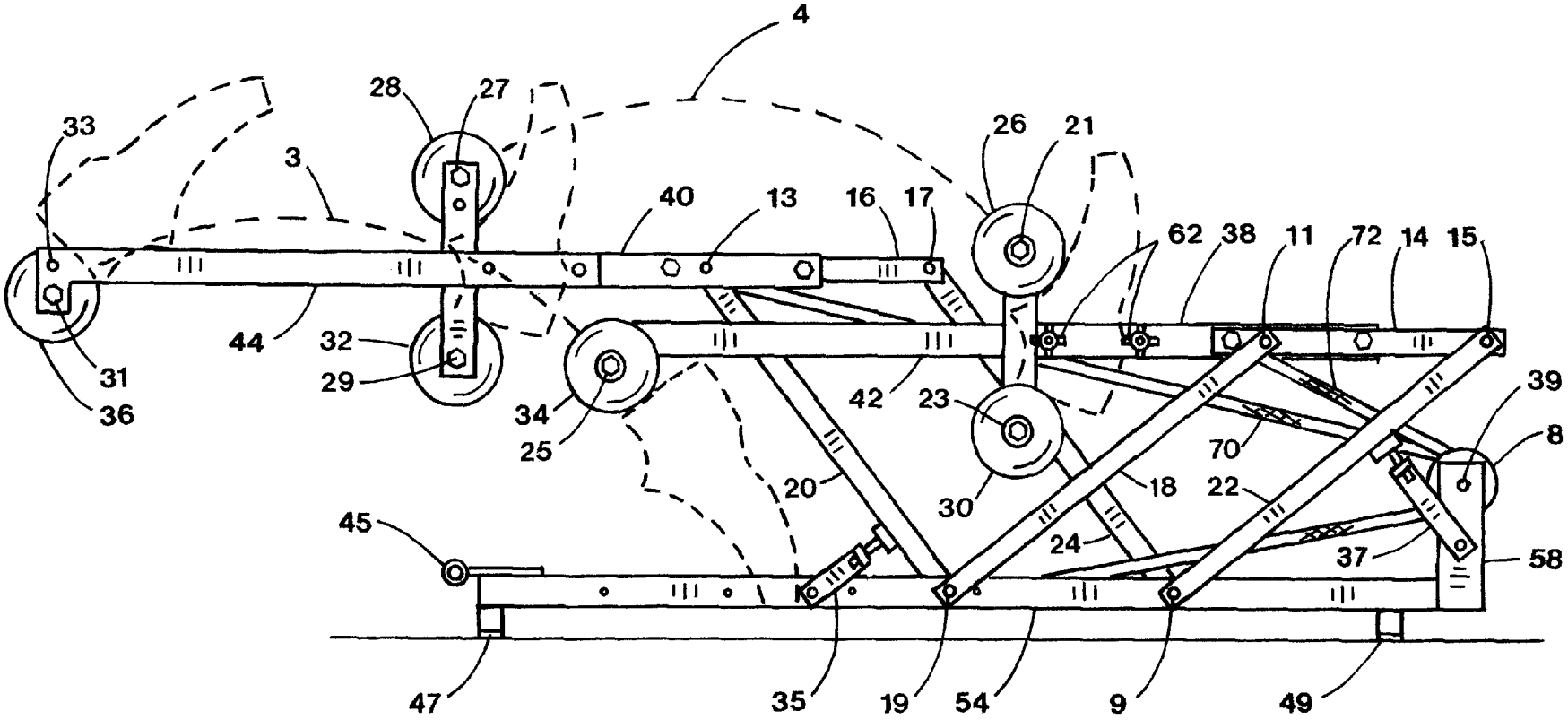
FIG. 1 is a side elevation view of the preferred embodiment of the present invention.
Figure 2:
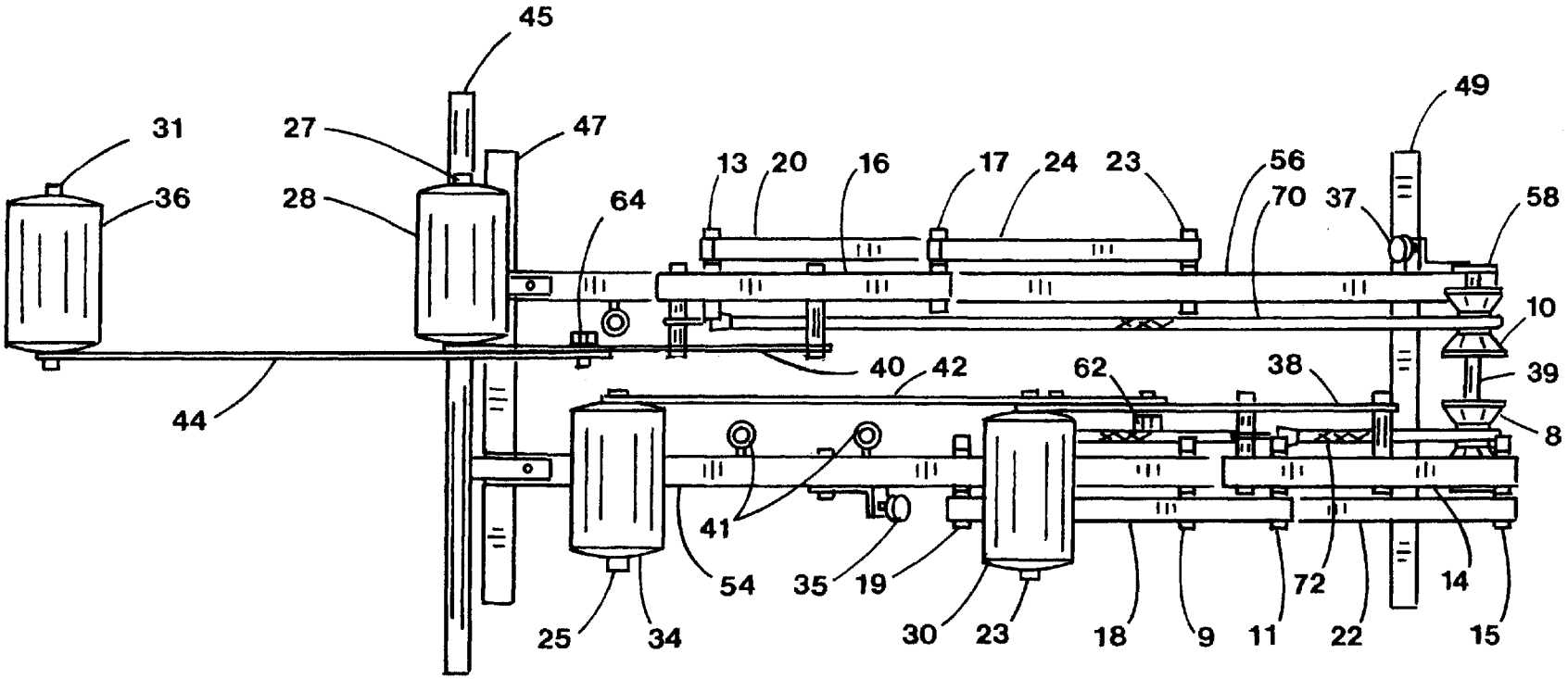
FIG. 2 is a plan view of the preferred embodiment shown in FIG. 1.
Figure 3:
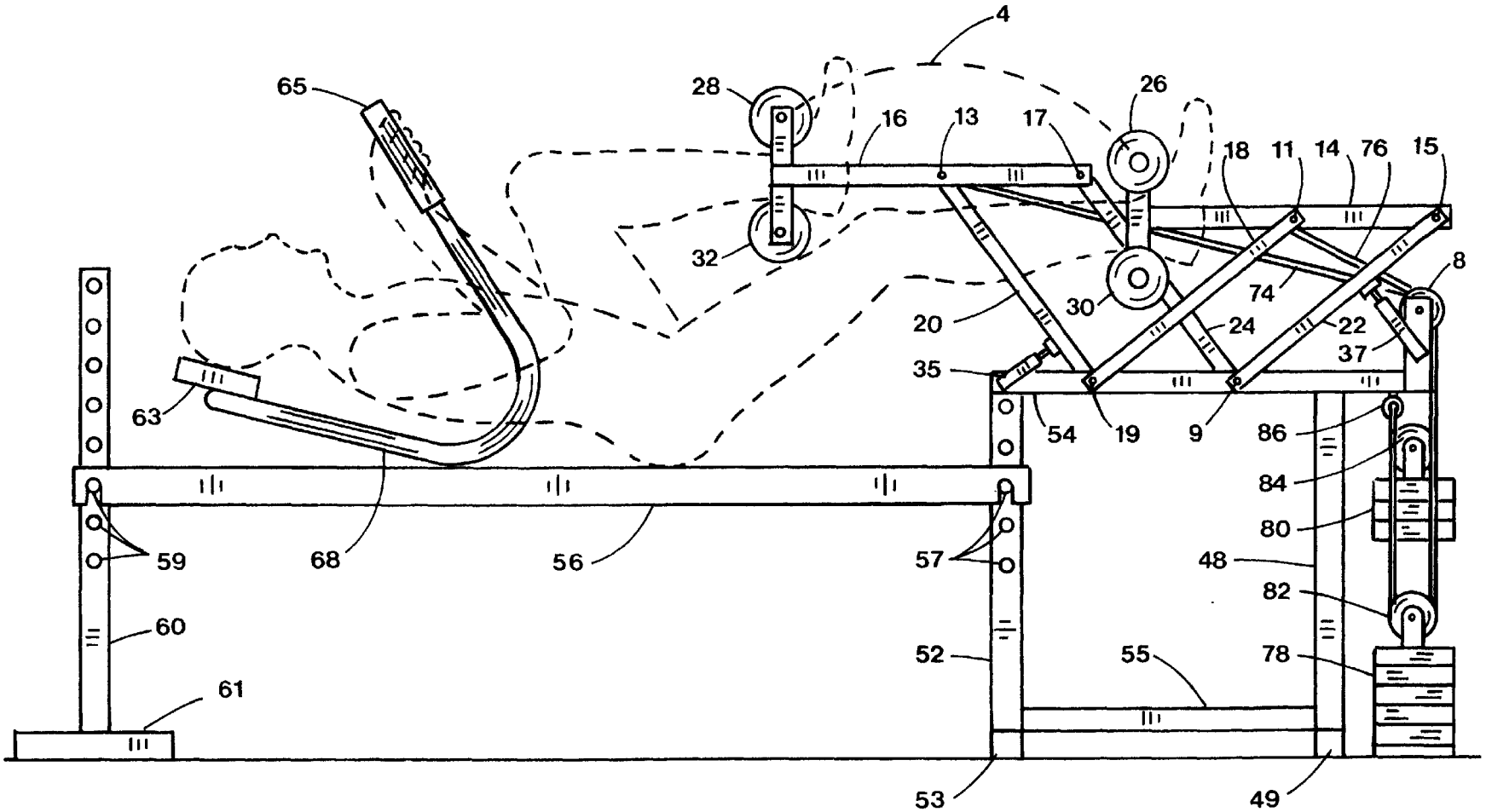
FIG. 3 is a side elevation view of an alternate embodiment of the present invention.

In the preferred embodiment shown in FIGS. 1 and 2, the lower leg contacts are shown as roller pairs 26,30 and 28,32 with the legs of the operator most bent and most extended. Foot contact rollers 26,28 contact the instep of the foot while rollers 30,32 contact the heel of the foot. As the lower leg is pulled towards the operator, the foot is too large to fit between the rollers 26,30 and 28,32 whereby force impinges upon the rollers 26,30 and 28,32 from the lower leg. The lower leg is positioned between rollers 26,30 and 28,32 from the outside open ends.

Rollers 26,30 are attached to guide link 38 at roller pins 21,23 and rollers 28,32 are attached to guide links 40 at roller pins 27,29. Guide links 38,40 are offset to guide pivot links 14,16. Support links 18,22 are connected to guide pivot link 14 at pivots 11,15 and support links 20,24 are connected to guide pivot link 16 at pivots 13,17. Support links 18,20 are connected to frame member 54 at pivot 19 and support links 22,24 are connected to frame member 54 at pivot 9. Stops 35 and 37 are adjustable to limit the range of movement for support links 18,20,22,24.

Frame members 54,56 are attached to crossover supports 47,49 which are configured to be supported by the floor. Handle 45 is attached to crossover support 47 for hand support. Brackets 58 are attached to frame members 54,56 to support pulley shaft 39 and pulleys 8,10.

Resistance is provided by elastic bands 70,72 which are attached at one end to guide links 14,16, wrap around pulleys 8,10 and attach at the other ends to one of eyebolts 41 on frame members 54,56. Tension is varied by the choice of eyebolt 41 location or by the addition of other elastic bands (not shown). When the operator pulls rollers 26,30 or 28,32 towards the upper body, either together or separately, the rollers 26,30 and 28,32 follow arcuate curve 4.

Guide link extensions 42,44 can be added to guide links 38,40 with hand knobs 62,64. Rollers 34,36 are attached to guide link extensions 42,44 at roller pins 25,31. Rollers 34,36 can be repositioned at alternate pin holes 33. The operator is prone face down with the heels in contact with rollers 34,36. The heel is moved towards the operator along an arcuate path 3 having a radius similar to the lower leg length. The elastic bands 70,72 return the rollers 34,36 to the rear starting position with support links 22,24 in contact with stops 37.

An alternate embodiment is given in FIG. 3 with guide links 14,16 in opposing positions. The lower leg contacts again take the form of rollers 26,28,30,32 connected to guide links 14,16. The operator is supported by bench 56 which is connected to pins 59 and 57. Several pins 59 on support stand 60,61 and pins 57 on upright support 52 allow the bench 56 to be positioned at different heights from the floor and at different angles.

Frame members 54,56 are supported by upright supports 48,52 which are attached to floor supports 49,53 and brace member 55. Resistance is provided by weight stacks 78,80 attached to pulleys 82,84 where different weights may be chosen by conventional means. Cables 74,76 are attached to guide links 14,16, pass over pulleys 8,10 and under pulleys 82,84 terminating at eyebolts 86 which are attached to frame members 54,56. As the lower leg is pulled towards the operator along arcuate path 3, weights 78,80 rise above the floor to exercise the leg and abdominal muscles. Gravity returns the rollers 26,30,28,32 to the starting positions.

Situp assist device 68 is shown in rollable contact with bench 56. Pad 63 supports the head with handles 65 supporting the arms. The upper abdominals are exercised when the head pad 63 is raised off the bench 56. Situp assist device 68 can be of other standard designs known in the trade or a combination of links to guide the head and arms and remain within the scope of this invention. Both the situp assist device 68 and rollers 26,30,28,32 can be operated together or separately. Leg curl extensions 42,44 can be added for leg curl exercise similar to the preferred embodiment.

Each of the embodiments provide pull/push apparatus motion which exercises the abdominals, back and leg muscles in a novel manner without back strain. Note that arcuate curves 3 and 4 can have different shapes and remain within the scope of the present invention. Arms may be used for support during exercise.

It should be understood that the elements disclosed in any one embodiment may be used in any of the other embodiments given. The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine for allowing a recumbent operator to move each foot of the operator through an arcuate curve comprising:

a framework, said framework configured to be supported by a supporting surface;

a pair of support links for each said foot, said support links pivotally connected to said framework;

a guide link for each foot, said guide link pivotally connected to said corresponding support links wherein a portion of said guide link follows said arcuate curve;

a pair of lower leg contacts for each foot, said lower leg contacts attached to said portion of said corresponding guide link;

said lower leg contacts configured to move relative to said framework when said feet of said recumbent operator applies force towards said operator upon said guide link whereby said lower leg contacts follow said arcuate curve with the hip of said recumbent operator positioned below said arcuate curve.

2. The exercise machine according to claim 1 wherein said guide links move independently of each other.

3. The exercise machine according to claim 1 further comprising a heel contact for each foot, said heel contact attached to a guide link extension whereby said operator in a face down position applies force to said heel contact moving said heel contact towards said operator for leg curl exercise.

4. The exercise machine according to claim 1 wherein said lower leg contacts comprise rollers attached to said guide link.

5. The exercise machine according to claim 4 wherein one of said rollers contacts the instep of the foot to apply force upon said guide link.

6. The exercise machine according to claim 4 wherein one of said rollers contacts the heel of the foot to apply force upon said guide link.

7. The exercise machine according to claim 1 further comprising a means for resistance, said means for resistance operably associated with said guide links and said framework.

8. The exercise machine according to claim 7 wherein said means for resistance comprises an adjustable damping means for variable resistance.

9. The exercise machine according to claim 7 wherein said means for resistance comprises an elastic member adjustably associated with said guide link and said framework for variable resistance.

10. The exercise machine according to claim 7 wherein said means for resistance comprises a weight stack, said weight stack operably associated with said guide link for the selection of different gravity loading.

11. The exercise machine according to claim 10 further comprising a cable and pulley system, said cable and pulley system operably associated with said weight stack and said guide link to provide gravity resistance against foot movement.

12. The exercise machine according to claim 1 further comprising a means to assist the operator with exercise of the upper abdominals, said means including a tubular structure configured to support the head of the operator during exercise.

13. The exercise machine according to claim 1 further comprising a bench to support the back of said operator, said bench having a means to adjust said bench to vary the angle of said bench relative to the supporting surface.

14. The exercise machine according to claim 13 further comprising a means to assist the operator with exercise of the upper abdominals, said means including a tubular structure operably associated with said bench and configured to support the head of the operator during exercise.

15. The exercise machine according to claim 1 further comprising a pair of handles, each said handle attached to said framework to provide upper body support during exercise.

16. The exercise machine according to claim 1 further comprising an adjustable means to limit the range of movement of said guide links, said adjustable means operably associated with said framework and said support links.

17. An exercise machine for use with an operator generally in a prone position with the face of said operator downward, comprising;

a framework configured to be supported by a surface;

a pair of support links for each foot of said operator, said support links pivotally connected to said framework;

a guide link for each foot, said guide link pivotally connected to said corresponding support links wherein a portion of said guide link follows said arcuate curve;

a pair of heel contacts, each said heel contact attached to said corresponding guide link;

a means for resistance, said means for resistance operably associated with said guide link and said framework;

said heel contact configured to move relative to said & framework when a lower leg of said operator is moving said guide link towards said operator wherein the movement of said heel contact provides said operator with leg curl exercise.

18. The exercise machine according to claim 17 wherein said heel contact comprises a roller attached to said guide link.

19. The exercise machine according to claim 17 further comprising a means for lower leg contact whereby said means for lower leg contact allows exercise of the abdominal muscles.

20. The exercise machine according to claim 17 wherein said means for resistance comprises an adjustable weight stack operably associated with said guide link.

21. The exercise machine according to claim 17 wherein said means for resistance comprises an elastic member adjustably associated with said guide link and said framework for variable resistance.

22. The exercise machine according to claim 17 further comprising an adjustable means to limit the range of movement of said guide links, said adjustable means operably associated with said framework and said support links.

23. An exercise machine for use with an operator generally in a prone position with face upwards, comprising;

a base configured to be supported;

a pair of support links for each foot of said operator, each said pair of support links operably associated with said base;

a pair of foot contacts, each said foot contact operably associated with said pair of support links for a back and forth movement above the hip of said operator;

a means to assist the operator in the exercise of the upper abdominals, said means operably associated with said base, said foot contact configured to move relative to said base when said foot of said operator is moving towards said operator whereby the lower and upper abdominal muscles can be exercised.

24. The exercise machine according to claim 23 further comprising a pair of pivot links, each said pivot link operably associated with said pair of support links and said foot contact.

25. The exercise machine according to claim 23 wherein said foot contact comprises a means for the instep of the foot to apply force upon said pair of support links.

26. The exercise machine according to claim 23 further comprising a means for resistance, said means for resistance operably associated with said foot contact and said base.

27. The exercise machine according to claim 23 wherein said means to assist the operator with exercise of the upper abdominals comprises a tubular structure, said tubular structure configured to support the head of the operator during exercise.

* * * * *